US011530520B2

(12) United States Patent
Kitamura et al.

(10) Patent No.: US 11,530,520 B2
(45) Date of Patent: Dec. 20, 2022

(54) PILE PRESS-IN MACHINE AND PILE PRESS-IN METHOD

(71) Applicant: GIKEN LTD., Kochi (JP)

(72) Inventors: Akio Kitamura, Kochi (JP); Hiroaki Tanouchi, Kochi (JP); Masaaki Ono, Kochi (JP); Toshio Ikeda, Kochi (JP)

(73) Assignee: GIKEN LTD., Kochi (JP)

( * ) Notice: Subject to any disclaimer, the term of this patent is extended or adjusted under 35 U.S.C. 154(b) by 0 days.

(21) Appl. No.: 16/494,032

(22) PCT Filed: Mar. 12, 2018

(86) PCT No.: PCT/JP2018/010669
§ 371 (c)(1),
(2) Date: Sep. 13, 2019

(87) PCT Pub. No.: WO2018/169091
PCT Pub. Date: Sep. 20, 2018

(65) Prior Publication Data

US 2020/0087883 A1 Mar. 19, 2020

(30) Foreign Application Priority Data

Mar. 13, 2017 (JP) ..... JP2017-047084

(51) Int. Cl.
*E02D 7/18* (2006.01)
*E02D 7/20* (2006.01)

(52) U.S. Cl.
CPC ..... *E02D 7/20* (2013.01)

(58) Field of Classification Search
CPC .. E02D 7/20; E02D 7/18; E02D 27/48; E02D 7/00; E02D 7/02; E02D 7/10;
(Continued)

(56) References Cited

U.S. PATENT DOCUMENTS 2,232,845 A * 2/1941 Fieroh ..... E02D 7/26 175/416
3,019,608 A * 2/1962 Marmion ..... E02D 13/10 405/232

(Continued)

FOREIGN PATENT DOCUMENTS

CN 106013150 A 10/2016
GB 2 448 613 A 10/2008

(Continued)

OTHER PUBLICATIONS

Office Action issued in Japanese Application No. 2019-530510, dated Nov. 26, 2019.

(Continued)

*Primary Examiner* — Edwin J Toledo-Duran
(74) *Attorney, Agent, or Firm* — Michael Best & Friedrich LLP

(57) ABSTRACT

A pile press-in machine that receives reaction force from an existing pile to press in a new pile, includes: a reaction force block that grips the existing pile by a clamp to receive the reaction force; a platform that is horizontally movable relative to the reaction force block; and a press-in block that is coupled to the platform, supported to be freely lifted up and down with respect to the platform at a front of the clamp, and grips and presses in the new pile, wherein a plurality of kinds of the reaction force blocks each according to a kind and size of the existing pile are freely attachable to and detachable from one platform.

15 Claims, 6 Drawing Sheets

(58) Field of Classification Search
CPC ..... E02D 13/00; E02D 27/34; E02D 27/16; E02D 5/74; E02D 27/01; E02D 5/24; E02D 31/10; E02D 5/22; E02D 3/054; E02D 5/00; E02D 15/08; E02D 9/00; E02D 35/005; E02D 5/02; E02D 5/68; E02D 27/30; E02D 29/00; E02D 3/074; E02D 5/03; E02D 5/187; E02D 7/22; E02D 7/14; E02D 7/26; E02D 2250/0038; E02D 11/00; E21B 31/03; C09K 8/32
USPC ..... 405/228–257
See application file for complete search history.

(56) References Cited

U.S. PATENT DOCUMENTS 3,279,195 A * 10/1966 Taylor ..... E02D 11/00 254/105
3,289,421 A * 12/1966 Hindman ..... E02D 7/00 405/226
3,344,873 A * 10/1967 Baittinger ..... E02D 7/18 175/19
3,657,896 A * 4/1972 Ishihara ..... E02D 7/20 173/159
3,927,861 A * 12/1975 Dumont ..... E02D 13/02 405/232
3,992,890 A * 11/1976 Pryke ..... E02D 7/20 405/232
4,022,433 A * 5/1977 Kondo ..... E02D 7/20 405/232
4,094,156 A * 6/1978 Dumont ..... E02D 7/26 175/171
4,131,166 A * 12/1978 Schnell ..... E02D 27/52 405/232
4,301,874 A * 11/1981 Majima ..... E02D 7/10 173/152
4,311,415 A * 1/1982 Christenson ..... E02D 3/11 204/515
4,382,475 A * 5/1983 Suzuki ..... E02D 11/00 173/206
4,626,138 A * 12/1986 Boyes ..... E02D 7/20 405/230
5,006,015 A * 4/1991 Stephens ..... E02D 7/20 405/230
5,040,927 A * 8/1991 Wickberg ..... E02D 7/20 173/44
5,135,335 A * 8/1992 Stephens ..... E02D 7/20 405/230
5,213,166 A * 5/1993 Watanabe ..... E21B 31/03 173/1
5,791,820 A * 8/1998 Rempel ..... E02D 7/20 405/303
5,803,672 A * 9/1998 Glass ..... E02D 7/14 405/232
6,368,023 B1 * 4/2002 Lau ..... E02D 7/10 173/53
6,896,071 B1 * 5/2005 Collins ..... E02D 7/20 173/90
2004/0188118 A1 * 9/2004 McPhee ..... E02D 7/16 173/49
2007/0065235 A1 * 3/2007 Glass ..... E02D 19/12 405/274
2007/0144360 A1 * 6/2007 Heichel ..... E02D 7/18 100/137
2010/0158616 A1 * 6/2010 Kishida ..... E02D 7/20 405/232
2010/0300757 A1 * 12/2010 He ..... E21B 27/00 175/57
2016/0090707 A1 * 3/2016 Korherr ..... E02D 7/08 405/232
2018/0298579 A1 * 10/2018 Ouyang ..... E02D 5/54
2020/0149241 A1 * 5/2020 Flanigan ..... E02D 7/22
2020/0283981 A1 * 9/2020 Shevtsov ..... E02D 7/08
2022/0010517 A1 * 1/2022 De Waard ..... E02D 11/00

FOREIGN PATENT DOCUMENTS

JP H02-282514 A 11/1990
JP H05-247937 A 9/1993
JP H06-193065 A 7/1994
JP H06-200525 A 7/1994
JP H06193065 A * 12/1994
JP 2003-213686 A 7/2003
JP 2004-270156 A 9/2004
JP 2004-316116 A 11/2004
JP 2011-226209 A 11/2011
JP 2014-062458 A 4/2014
JP 2014-141845 A 8/2014

OTHER PUBLICATIONS

International Search Report issued in Application No. PCT/JP2018/010669, dated May 29, 2018.
Office Action issued in Chinese Application No. 201880017723.9, dated Jan. 21, 2021.
"Combi-Gyro Method," article obtained from www.giken.com, Giken Construction Solutions Company, Giken Ltd., Ver 2.1 EN05, Jan. 12, 2018.
Article 94(3) EPC Communication issued in European Patent Application No. 18 718 233.2-1002, dated Mar. 7, 2022.

* cited by examiner

PILE PRESS-IN MACHINE AND PILE PRESS-IN METHOD

TECHNICAL FIELD

The present invention relates to a pile press-in machine and a pile press-in method that press a pile into the ground.

BACKGROUND ART

As a method of installing various steel pipe piles and sheet piles into the ground, there is a known constructing method of gripping upper ends of previously installed piles in the ground by clamps to receive reaction force, lifting up and down a chuck grasping the piles to press new piles into positions adjacent to the existing piles in sequence, as disclosed, for example, in Patent Document 1 or the like.

A pile press-in machine used for the construction includes a saddle fixed to existing piles via a plurality of clamps, and a slide frame movable in a front-rear direction with respect to the saddle. To the slide frame, the chuck is attached via a leader mast and a chuck frame. Further, the chuck is provided with a chuck mechanism that grasps the pile to be pressed in. The chuck mechanism grasps the pile to be pressed in and the chuck is positioned at a predetermined position with respect to the saddle, and the chuck frame and the chuck are then integrally lifted up and down along the leader mast to press the pile into the ground. For improvement of the working efficiency at that time, for example, a clamp mechanism made to be slidable from and attachable to and detachable from the saddle is disclosed, for example, in Patent Document 2.

As the pile used for press-in, for example, piles such as a steel sheet pile, a tubular sheet pile, a steel pipe pile, and a concrete pile are known. These piles have various shapes and sizes. Conventionally, at the time when constructing piles different in kind such as the steel sheet pile and the steel pipe pile or the steel sheet pile and the concrete pile, a dedicated pile press-in machine independently manufactured according to the dimension of the pile is used each time.

Alternatively, when the piles are of the same kind different in dimension, a method of preparing a plurality of chucks each according to the dimension and the joint pitch of the pile to be constructed and replacing a chuck portion is known. In this case, it is disclosed in Patent Document 3 that, for example, in the case of changing a steel pipe pile having a small diameter to a pile having a larger diameter regarding the existing pile, a cover is put on the clamp to cope with a steel pipe pile different in dimension. Further, Patent Documents 4, 5 disclose methods of coping with a change in joint pitch by adjusting the arrangement of clamps, for example, in the case of changing a steel sheet pile from a 400 mm wide to a 600 mm wide.

PRIOR ART DOCUMENT

[Patent Document]

[Patent Document 1] Japanese Laid-open Patent Publication No. 2004-270156

[Patent Document 2] Japanese Laid-open Patent Publication No. H2-282514

[Patent Document 3] Japanese Laid-open Patent Publication No. 2004-316116

[Patent Document 4] Japanese Laid-open Patent Publication No. 2011-226209

[Patent Document 5] Japanese Laid-open Patent Publication No. 2014-62458

DISCLOSURE OF THE INVENTION

Problems to Be Solved by the Invention

However, the above-described methods can cope only with piles comparatively close in dimension, and the above-described Patent Document 3 cannot cope with the case where, for example, steel pipe piles largely different in dimension such as from a Φ of 1000 mm to a Φ of 1500 mm. Besides, the above-described Patent Documents 4, 5 disclose that the methods cope with the case where the width of sheet piles is from about 400 mm to about 600 mm, and thus cannot cope with a great change in dimension such as from 400 mm to 900 mm. In addition, according to Patent Documents 4, 5, the number of clamps decreases when the width increases in terms of constraint of the space of the saddle, but at the time when constructing a pile having a large dimension, rather larger reaction force is required, and therefore a decrease in the number of clamps is not preferable. Accordingly, when piles are greatly different in kind, dimension, and width, different kinds of pile press-in machines designed exclusively for them need to be used conventionally, bringing about a problem of an increase in labor and cost.

Further, in Patent Documents 4, 5, a plurality of clamps is removed and replaced for exchanging clamps. At the time of exchanging clamps, it is necessary to remove and connect a plurality of hydraulic pipes connected to each clamp in order to open/close and move right/left the clamp as well as to replace the clamp itself, requiring a lot of work time. Additionally, the replacement of the hydraulic pipes requires skill, causing a problem of a risk such as a mechanical trouble due to oil leakage and erroneous work.

The present invention has been made in consideration of the above points, and its object is to provide a pile press-in machine and a pile press-in method, capable of coping with construction of piles different in kind, dimension, and width at a low cost and in a short time.

[Means for Solving the Problems]

To achieve the above object, according to the present invention, there is provided a pile press-in machine that receives reaction force from existing piles to press in a new pile, including: a reaction force block that grips the existing piles by a clamp to receive the reaction force; a platform that is horizontally movable relative to the reaction force block; and a press-in block that is coupled to the platform, supported to be freely lifted up and down with respect to the platform at a front of the clamp, and grips and presses in the new pile, wherein a plurality of kinds of the reaction force blocks each according to a kind and size of the existing pile are freely attachable to and detachable from one platform.

Further, according to the present invention, there is provided a pile press-in method using a pile press-in machine, the pile press-in machine including: a reaction force block that grips an existing pile by a clamp to receive reaction force; a platform that is horizontally movable relative to the reaction force block; and a press-in block that is coupled to the platform, supported to be freely lifted up and down with respect to the platform at a front of the clamp, and grips and presses in the new pile, wherein a reaction force block corresponding to a kind and size of the existing piles is selected from a plurality of kinds of the reaction force blocks freely attachable to and detachable from one platform, and is attached to the platform.

[Effect of the Invention]

According to the present invention, it is possible to perform construction of piles greatly different in shape and dimension without much cost and labor by attaching a reaction force block coping with construction of various piles to a common platform.

BEST MODE FOR CARRYING OUT THE INVENTION

Figure 1:
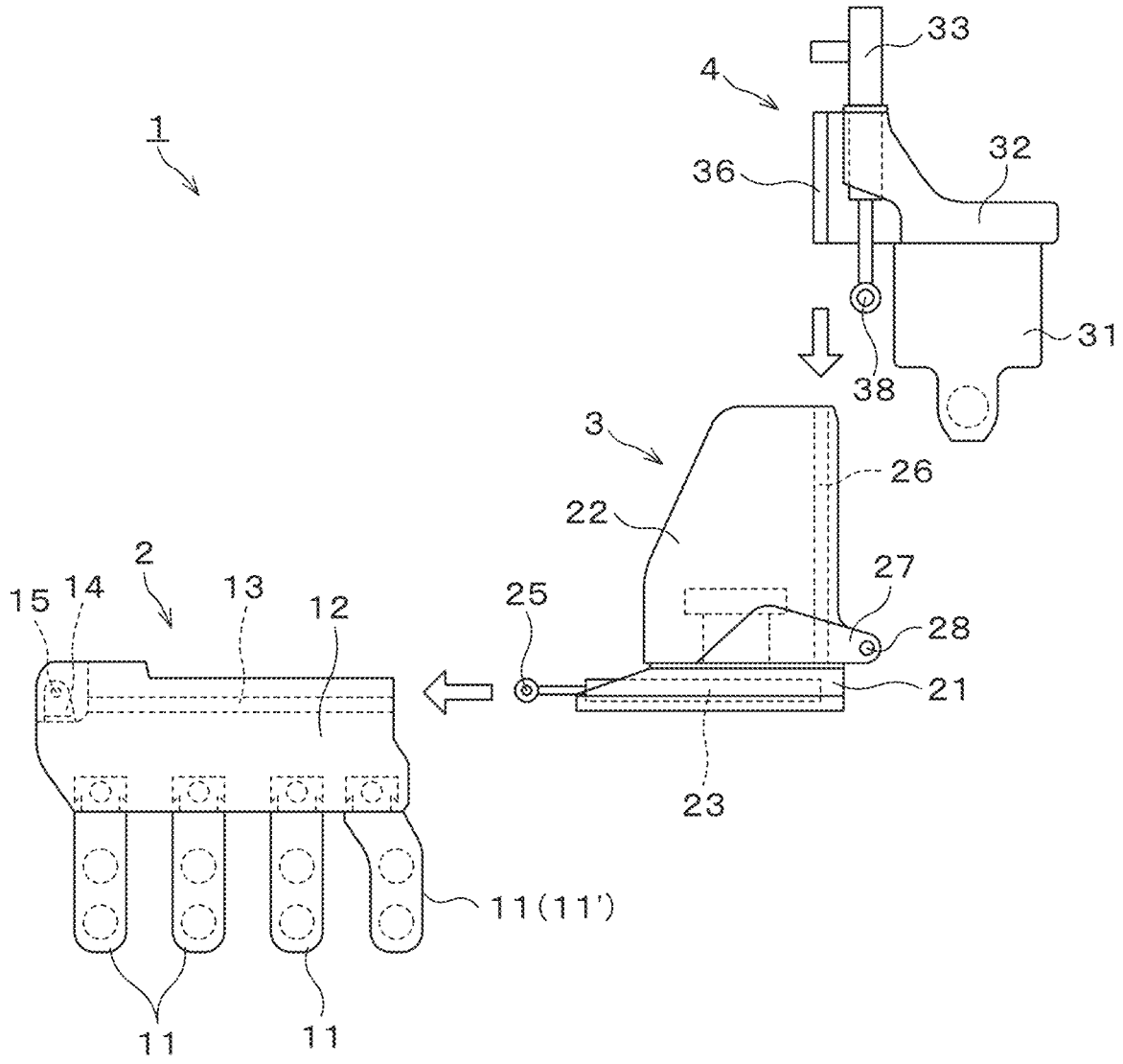
FIG. 1 is a side view of a decomposed pile press-in machine according to an embodiment of the present invention.

Hereinafter, embodiments of the present invention will be described referring to the drawings. Note that in this description and the drawings, components having substantially the same functional configurations are denoted by the same numerals to omit duplicated description.

Figure 2:
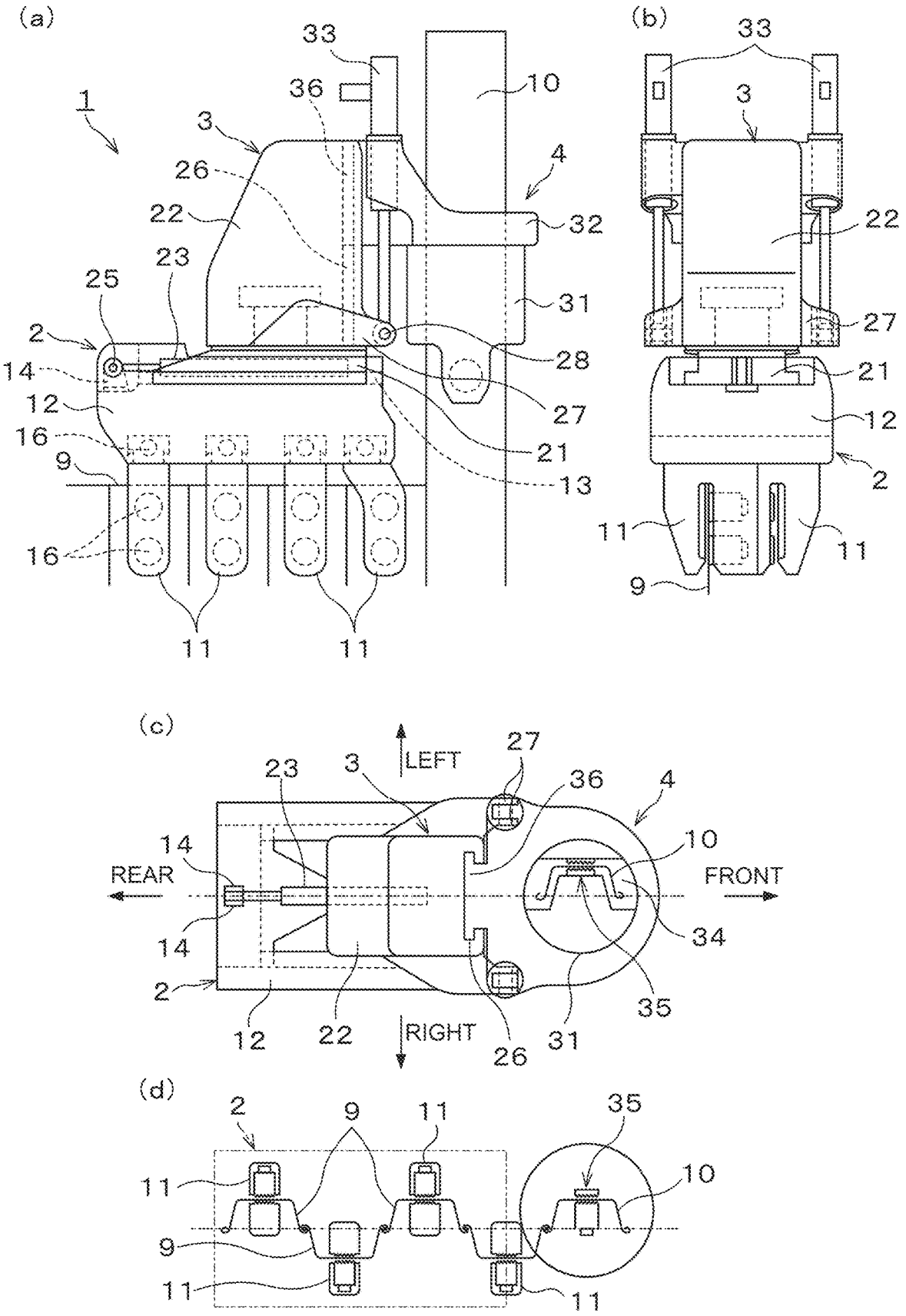
FIG. 2(*a*) to FIG. 2(*d*) are schematic views illustrating an appearance of constructing a pile of a steel sheet pile by the pile press-in machine according to the embodiment of the present invention, FIG. 2(*a*) is a side view, FIG. 2(*b*) is a back view, FIG. 2(*c*) is a plan view seen from above, and FIG. 2(*d*) is a plan view illustrating the relationship between clamps and a chuck and piles.
Figure 3:
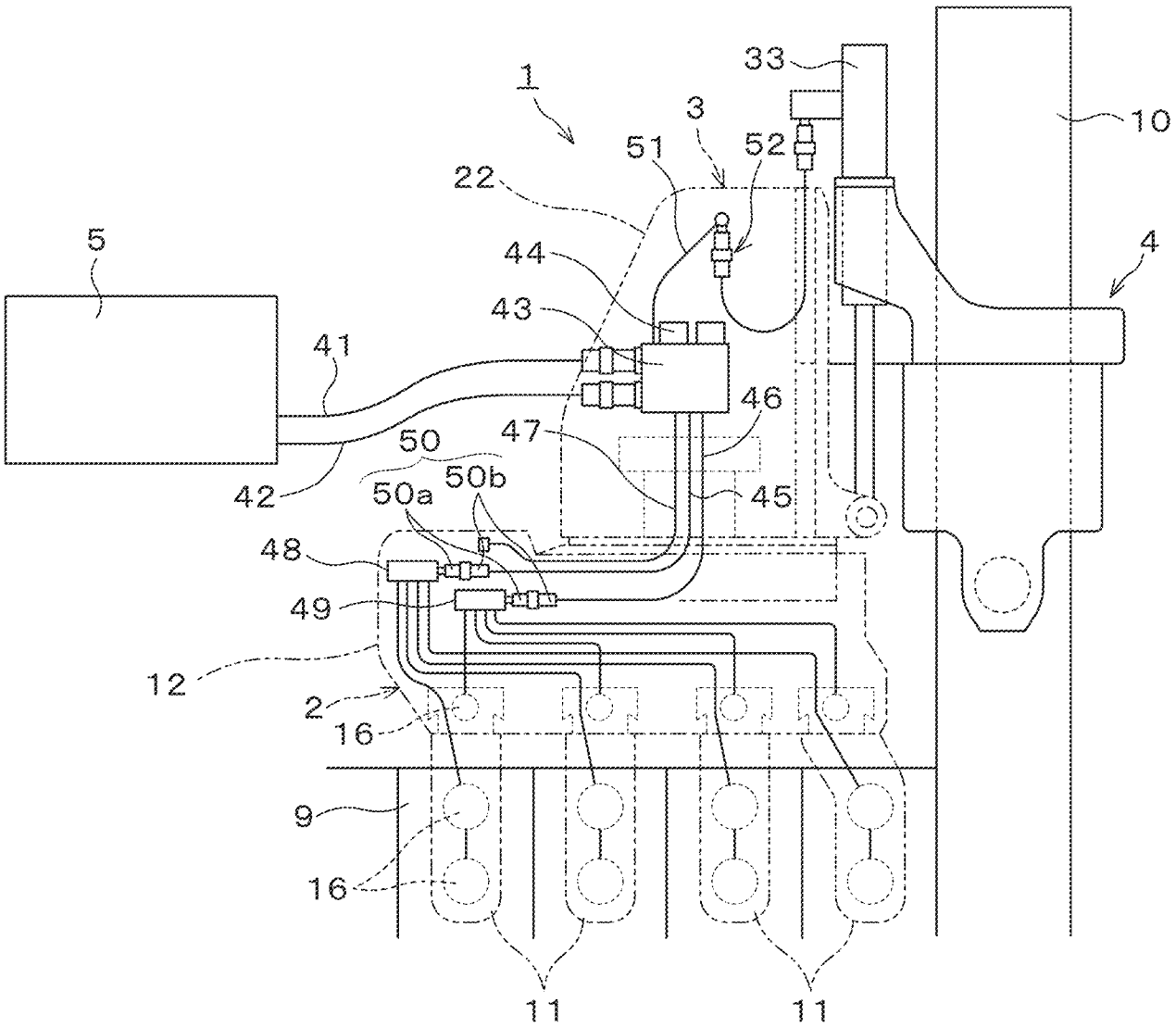
FIG. 3 is an explanatory view of hydraulic pipes of the pile press-in machine in FIG. 1.

FIG. 1 is a view of a pile press-in machine 1 according to the embodiment of the present invention decomposed into blocks, FIG. 2(*a*) to FIG. 2(*d*) are views illustrating an appearance at construction by the pile press-in machine 1 in the case where a pile is a steel sheet pile, and FIG. 3 is an enlarged view illustrating an example of hydraulic pipes of the pile press-in machine 1. As illustrated in FIG. 1, the pile press-in machine 1 is constituted by combining a reaction force block 2, a platform 3, and a press-in block 4.

The reaction force block 2 includes a plurality of clamps 11 and a saddle 12 mounted with the clamps 11. In this embodiment, four clamps 11 are mounted in a front-rear direction of the saddle 12. The clamp 11 has a function of gripping, by hydraulic pressure, an upper end of an existing pile 9 previously installed in the ground to fix the saddle 12 so as to receive reaction force for press-in. In this embodiment, a clamp 11' at a position closest to the press-in block 4 among the plurality of clamps 11 is provided to be eccentric so as to project to the press-in block 4 side further than the saddle 12, and the other clamps are each shaped in a straight line in an up-down direction so as to achieve a better balance in strength as compared with the curved one and to achieve a reduction in weight. As for the positional relationship, the clamps 11 are movable right/left at a lower surface of the saddle 12.

Note that in this description, the front is a direction in which press-in construction is advanced by the pile press-in machine 1, and the right side on a paper plane is the front and the left side on the paper plane is the rear in FIG. 2(*a*), FIG. 2(*c*), FIG. 2(*d*). The right-left direction is decided in a state where the advancing direction of the press-in construction is seen from above, the lower side on the paper plane is the right and the upper side on the paper plane is the left in FIG. 2(*c*), FIG. 2(*d*).

On upper portions on both right and left sides of the saddle 12, for example, slide guides 13 each in a groove shape extending from the tip on the front side toward the rear are provided. Further, on an end portion on the rear side at a middle in a width direction of the saddle 12, brackets 14 as fixed portions are provided to which another end of a front-rear cylinder 23 having one end fixed to the later-described platform 3 is fixed.

The platform 3 includes a slide frame 21 that is attached to the upper surface of the saddle 12, and a leader mast 22. The slide frame 21 is placed on the upper surface of the saddle 12 and slides along the slide guides 13. Further, to the slide frame 21, the one end of the front-rear cylinder 23 is fixed. A hole 25 formed at the other end of the front-rear cylinder 23 is aligned with holes 15 of the brackets 14 and fastened by pins, tubes or the like, whereby the reaction force block 2 and the platform 3 are coupled via the front-rear cylinder 23. Note that the one end of the front-rear cylinder 23 may be fixed to the reaction force block 2 side, and a fixed portion may be provided on the slide frame 21 side. Alternatively, fixed portions may be provided on both the reaction force block 2 and the slide frame 21 sides, and both ends of the front-rear cylinder 23 may be fixed to the fixed portions.

Further, as illustrated in FIG. 3, the leader mast 22 is equipped with a control manifold 43 to which an oil feed pipe 41 and an oil return pipe 42 extending from the hydraulic unit 5 are connected. From the control manifold 43, oil is fed via hydraulic hoses to hydraulic cylinders 16 of the clamps 11 and to lifting cylinders 33 of the later-described press-in block 4 to control the motions of the clamps 11 and the press-in block 4.

Slide guides 26, each of which are, for example, formed in a groove shape and into which a sliding portion 36 of the press-in block 4 is fitted, are provided in the front side of the leader mast 22, and brackets 27 for attaching the press-in block 4 thereto are provided on both right and left sides of a front lower portion of the leader mast 22.

The press-in block 4 includes a chuck 31 that grips a pile 10 to be newly driven (or pulled out), a chuck frame 32 that supports the chuck 31, and the lifting cylinders 33 that lift up and down the chuck frame 32 with respect to the platform 3. The chuck 31 is provided with an opening portion 34 through which the pile 10 is passed in the up-down direction, and a chuck mechanism 35 that grasps the pile 10 passed through the opening portion 34. In the embodiment illustrated in FIG. 2(*c*), the chuck mechanism 35 is composed of a pair of claws pinching the pile 10 therebetween.

The chuck frame 32 includes, at the rear side, the sliding portion 36 that slides along the slide guides 26 in a state of being fitted in the slide guides 26 of the platform 3, and a pair of lifting cylinders 33 whose tips are fixed to the brackets 27 of the platform 3. Holes 38 at tips of the lifting cylinders 33 are aligned with the holes 28 of the brackets 27 and fastened by pins, tubes or the like, whereby the press-in block 4 and the platform 3 are coupled via the lifting cylinders 33.

As illustrated in FIG. 3, the oil feed pipe 41 and the oil return pipe 42 connected to the hydraulic unit 5 provided outside the pile press-in machine 1 are connected to the control manifold 43 installed in the leader mast 22, and oil is fed by a switching valve 44 to the clamps 11 side or the lifting cylinders 33 side to control opening/closing and right/left movement or front/rear movement of the clamps 11, and up/down movement of the chuck 31 supported by the chuck frame 32. As for pipes to the clamps 11, as illustrated in FIG. 3, for example, hydraulic hoses 45, 46, 47 for clamp opening/closing, for right/left movement, and for front/rear movement are separately connected to the control manifold 43, and dividing manifolds 48, 49 are connected via hydraulic hoses to the hydraulic cylinders 16 that position respective motions of the four clamps 11. These pipes are coupled by connection between couplers 50*a* provided on the upstream side of the dividing manifolds 48, 49 and couplers 50*b* attached to tips of the hydraulic hoses 45, 46, 47. The couplers 50*a*, 50*b* are arranged at a rear portion of the saddle 12 located on the rear of the leader mast 22. Note that FIG. 3 is an example of the pipes for the steel sheet pile illustrated in FIG. 2(*a*) to FIG. 2(*d*), in which since front/rear adjustment of the clamps 11 is not necessary, the tip of the hydraulic hose 47 for front/rear movement is closed, so that the clamps 11 are not moved front/rear in this embodiment. However, when positional adjustment in the front-rear direction is necessary like a steel pipe pile or the like, the hydraulic hose 47 is similarly connected. Further, two pipes of each of the hydraulic hoses for opening/closing and positioning right/left movement of the clamps 11 exist in FIG. 3 but are illustrated as one pipe. At the time of replacing the reaction force block 2, the hydraulic hoses may be connected one by one without using the coupler 50, but use of the coupler 50 can simplify complicated piping work and prevent oil leakage and erroneous work. Note that though the platform 3 illustrated in FIG. 3 includes the hydraulic hoses 45, 46, 47 for opening/closing, for right/left movement, and for front/rear movement of the clamps 11, the hydraulic hose 47 for front/rear movement does not have to be provided in the case of a platform dedicated for a pile requiring no front/rear movement of the clamps 11.

Further, hydraulic hoses 51 that feed oil from the control manifold 43 to the lifting cylinders 33 side are similarly coupled by connection of couplers 52. The couplers 52 are arranged at an upper portion of the leader mast 22 or at upper portions of the lifting cylinders 33.

As described above, the reaction force block 2, the platform 3, and the press-in block 4 are combined as indicated by arrows in FIG. 1 to constitute the pile press-in machine 1. More specifically, the slide frame 21 of the platform 3 is attached along the slide guides 13 of the reaction force block 2 to fix the front-rear cylinder 23 and the brackets 14 by pins, tubes or the like, and the sliding portion 36 of the press-in block 4 is attached along the slide guides 26 of the platform 3 to fix the lifting cylinders 33 and the brackets 27 by pins, tubes or the like. Thereafter, the hydraulic pipes are connected, the positions of the clamps 11 are appropriately moved, and the clamps 11 grip the upper end portions of the existing piles 9. In the pile press-in machine 1, the leader mast 22 is mounted on the upper surface of the reaction force block 2 via the slide frame 21 movable in the front-rear direction, and the press-in block 4 equipped with the chuck 31 is arranged at the front of the leader mast 22. Movement in the front-rear direction of the slide frame 21 on the upper surface of the saddle 12 integrally moves front/rear the platform 3 and the press-in block 4. Further, the operation of the lifting cylinders 33 lifts up and down the chuck 31 supported by the chuck frame 32. Further, the chuck 31 is rotatable on the lower surface of the chuck frame 32. At the time when the pile 10 is driven and then the pile press-in machine 1 advances to the front for construction of a next pile 10, the pile press-in machine 1 advances with the clamps 11 being opened and appropriately moved (evacuated) in the right-left direction, and shifts to the motion of gripping a next existing pile 9.

As the reaction force block 2 and the press-in block 4, those according to the kinds and sizes of the existing pile 9 to be handled and the pile 10 to be newly driven are used. Unifying in advance the sizes of the slide guides 13 of the reaction force block 2, the holes 15 of the brackets 14, the sliding portion 36 of the press-in block 4, and the holes 38 at the tips of the lifting cylinders 33 that are coupling portions between the blocks with the sizes of the slide frame 21 of the platform 3, the hole 25 of the front-rear cylinder 23, the slide guides 26, and the holes 28 of the brackets 27 respectively, makes it possible to use the pile press-in machine 1 for construction of piles various in kind and size only by replacement with a reaction force block 2 and a press-in block 4 according to the type of a pile with respect to one kind of platform 3. Particularly according to the present invention, since the reaction force block 2 can be exchanged according to the existing pile 9, a desired number of clamps 11 can be appropriately arranged according to the existing pile 9, so that the posture of the pile press-in machine 1 can be stabilized regardless of the kind of the existing pile 9 and sufficient reaction force can be obtained.

At the time when the pile press-in machine 1 configured as described above constructs the pile 10, the reaction force block 2 is first fixed to the existing piles 9 by the clamps 11, and in this state, the slide frame 21 moves in the front-rear direction, and the chuck 31 grasping the pile 10 is positioned at a predetermined position at the front of the saddle 12. In the state where the pile 10 is thus positioned, the chuck frame 32 and the chuck 31 are integrally lifted up and down by the operation of the lifting cylinders 33, and the chuck 31 grasps the pile 10 when lifted down and releases the grasping when lifted up, whereby the pile 10 is pressed into a position adjacent to the front end of the existing pile 9.

Figure 4:
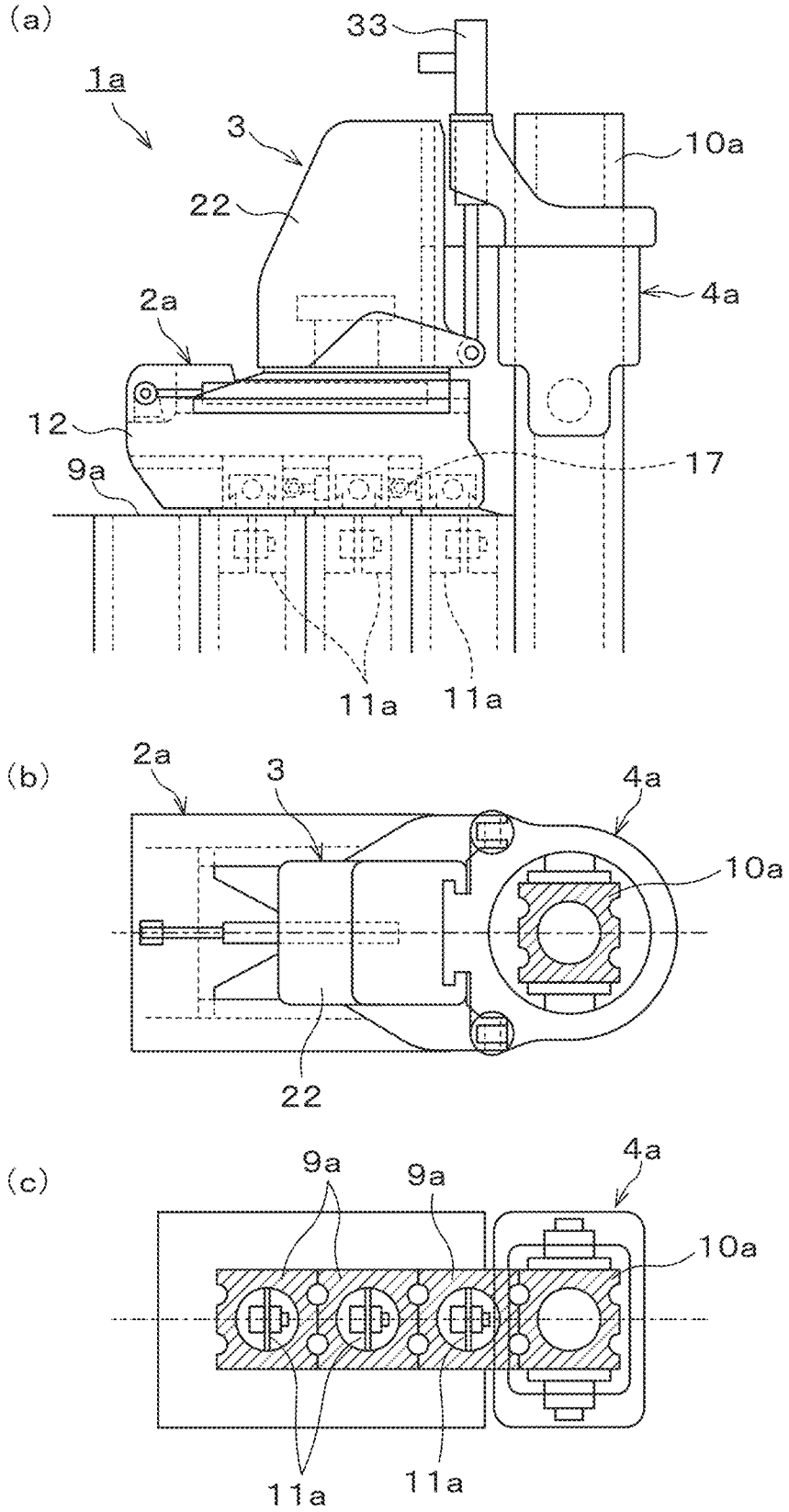
FIG. 4(*a*) to FIG. 4(*c*) are schematic views illustrating an appearance of constructing a pile of a concrete wall by a pile press-in machine according to a different embodiment of the present invention, FIG. 4(*a*) is a side view, FIG. 4(*b*) is a plan view seen from above, and FIG. 4(*c*) is a plan view illustrating the relationship between clamps and a chuck and piles.

FIG. 4(*a*), FIG. 4(*b*), FIG. 4(*c*) illustrate an embodiment of a pile press-in machine 1*a* in the case of constructing a pile of a concrete wall. The pile press-in machine 1*a* commonly has the platform 3 according to the above-described embodiment, and has replaced reaction force block 2*a* and press-in block 4*a* manufactured according to existing piles 9*a* and a pile 10*a* each of a concrete wall, and is the same as that in the above-described embodiment except for the structure that the reaction force block 2*a* and the press-in block 4*a* grip the existing piles 9*a* and the pile 10*a*. In the reaction force block 2*a*, the clamps 11*a* move by a front-rear moving hydraulic cylinder 17 and thereby cope with the dimension and the joint pitch of the existing piles 9*a* to receive reaction force from the existing piles 9*a*.

Figure 5:
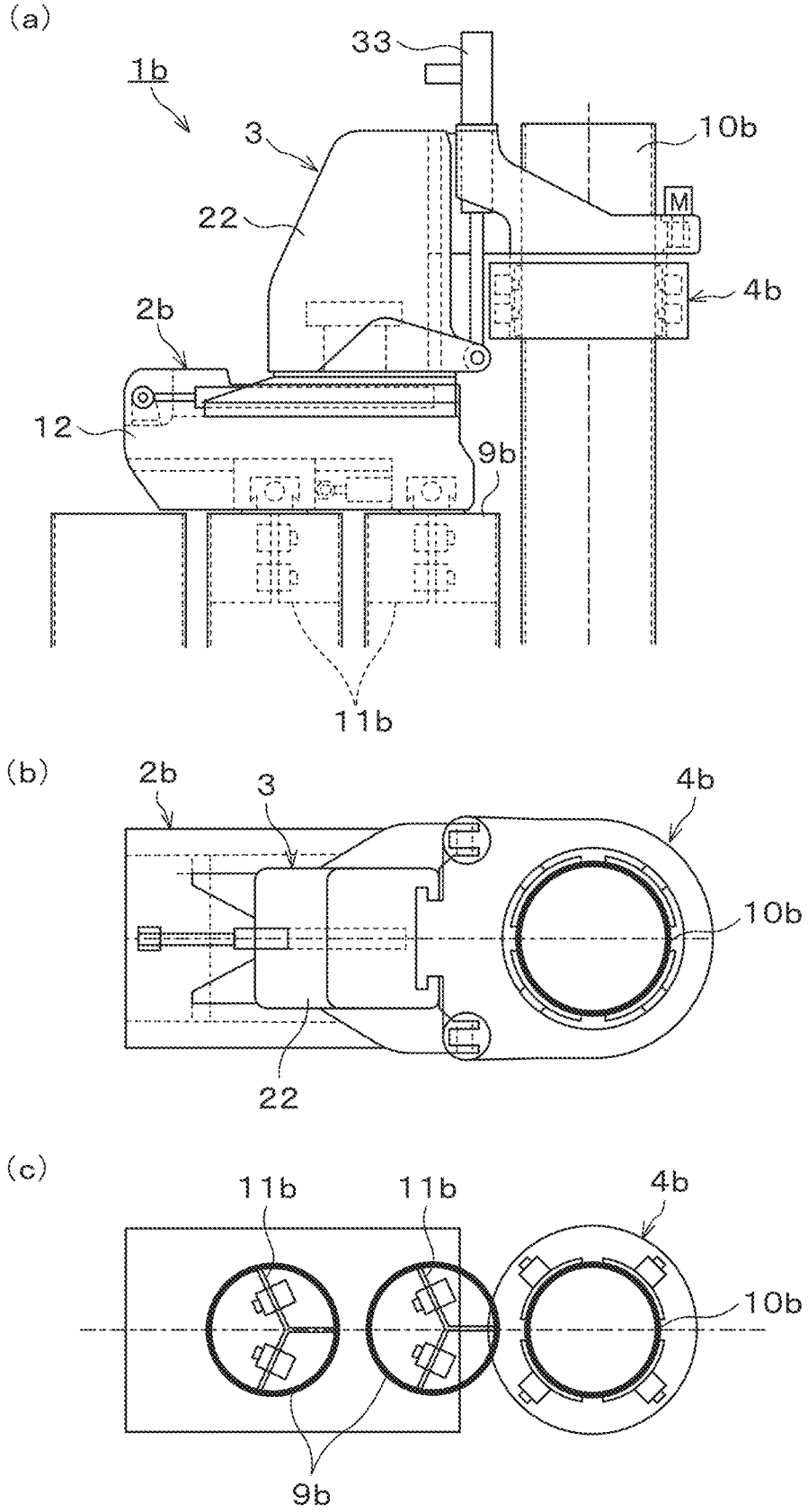
FIG. 5(*a*) to FIG. 5(*c*) are schematic views illustrating an appearance of constructing a pile of a steel pipe pile by a pile press-in machine according to a further different embodiment of the present invention, FIG. 5(*a*) is a side view, FIG. 5(*b*) is a plan view seen from above, and FIG. 5(*c*) is a plan view illustrating the relationship between clamps and a chuck and piles.

FIG. 5(*a*), FIG. 5(*b*), FIG. 5(*c*) illustrate an embodiment of a pile press-in machine 1*b* in the case of constructing a steel pipe pile. Also in this case, the pile press-in machine 1*b* commonly has the platform 3 according to the above-described embodiment, and has replaced reaction force block 2*b* and press-in block 4*b* manufactured according to existing piles 9*b* and a pile 10*b* each of a steel pipe, and is the same as that in the above-described embodiment except for the structure that the reaction force block 2*b* and the press-in block 4*b* grip the existing piles 9*b* and the pile 10*b*. Note that the press-in method includes a case of pressing in with rotation and a case of pressing in without rotation. In the reaction force block 2*b*, the clamps 11*b* are adjusted in attachment angle according to the dimension and the joint pitch of the existing piles 9*b* to receive reaction force from the existing piles 9*b*.

Figure 6:
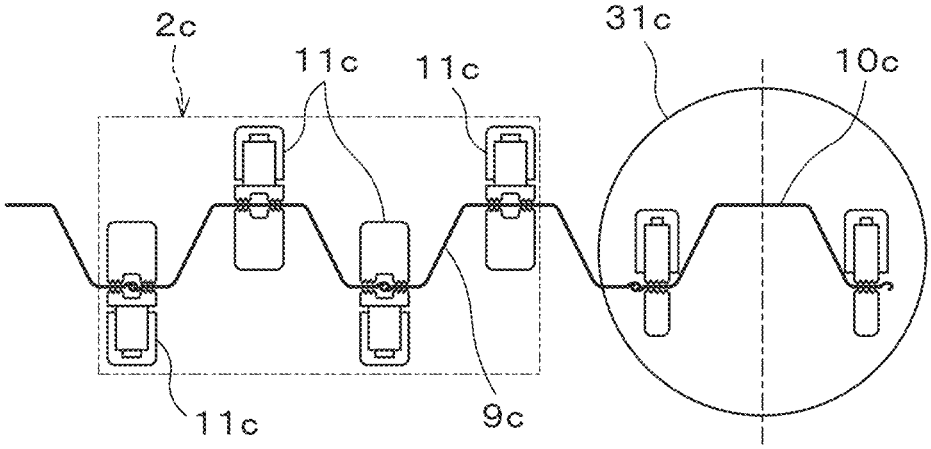
FIG. 6 A plan view illustrating the relationship between clamps and a chuck and piles when constructing a pile composed of a steel sheet pile having a larger dimension as that in FIG. 2(*a*) to FIG. 2(*d*).

FIG. 6 illustrates a support state of existing piles 9*c* and a pile 10*c* in the case where the kind of the pile is the steel sheet pile that is the same kind as that in the embodiment in FIG. 2(*a*) to FIG. 2(*d*) and the dimension (width) is large. For example, FIG. 2(*a*) to FIG. 2(*d*) illustrate a case of a 400 mm pitch and FIG. 6 illustrates a case of a 900 mm width. Also in this case, the pile press-in machine 1 commonly has the same platform 3 as in FIG. 2(*a*) to FIG. 2(*d*), and has a reaction force block equipped with clamps 11*c* for wide pile and a press-in block equipped with a chuck 31*c* for wide pile attached thereto to support the existing piles 9*c*, and thereby can construct the pile 10*c*. According to this embodiment, replacement with the reaction force block for wide pile makes it possible to receive reaction force from the existing piles 9*c* by using the same number as that in the case of a small diameter or a required number of the clamps 11*c* without restriction by a space or the like.

Besides, in the case of used, for example, for a construction method of reinforcing a steel sheet pile wall by driving a steel pipe pile beside an existing steel sheet pile, the present invention can easily cope also with a case where the reaction force block 2 and the press-in block 4 are for piles of different kinds such as the existing pile 9 from which the reaction force is received is a steel sheet pile and the pile 10 to be newly driven is a steel pipe pile, by attaching the reaction force block 2 and the press-in block 4 in respective specifications to the platform 3.

Figure 7:
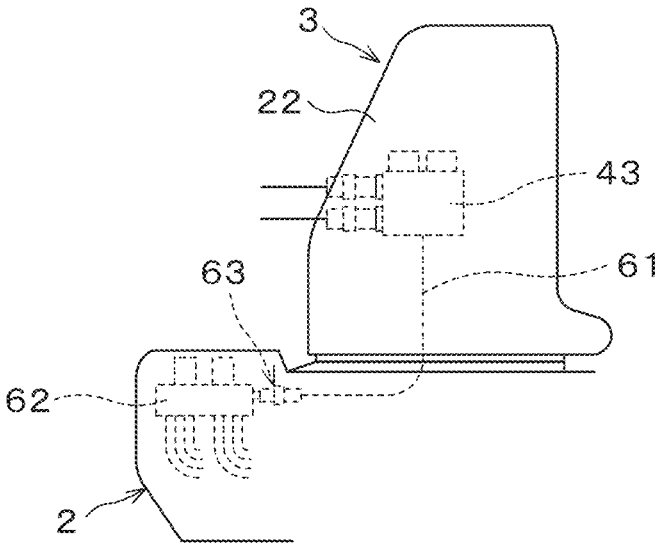
FIG. 7 An explanatory view illustrating a different embodiment of hydraulic pipes of the pile press-in machine of the present invention.

FIG. 7 illustrates a different embodiment of the present invention and illustrates a different example of the hydraulic pipes. In the case of FIG. 7, piping is made so that oil is fed to one dividing manifold 62 by two hydraulic hoses 61 in total one for each of oil feeding and oil return as the hydraulic hoses for opening/closing and right/left movement of the clamps 11, and is divided therefrom into hydraulic cylinders of the clamps 11. In this case, the connection of the hydraulic pipes with the platform 3 is made only by two couplers 63 in replacement of the reaction force block 2, thereby making it possible to save labor and prevent mechanical troubles due to oil leakage and erroneous work. For example, in the case of a conventional pile press-in machine equipped with hydraulic pipes (however, equipped with no coupler 50) that the reaction force block 2 illustrated in FIG. 3, for example, connection and plugging of 12 hydraulic hoses in total are required because of rearragement of three clamps except the clamp at a position closest to the press-in block 4 at the time when changing the kind of the pile. Employment of the embodiment in FIG. 7 only requires attachment and detachment of the two couplers 63, thereby reducing the work amount corresponding to 10 hydraulic hoses. Note that, in FIG. 7, the pipes (hydraulic hoses) for oil feeding and oil return and the connections (couplers) are illustrated by one each.

According to the above embodiment, the case where the kinds of piles are different and the case where the same kind of piles are large in dimensional difference can be coped with by exchanging both or one of the reaction force block 2 and the press-in block 4 according to a pile to be constructed with respect to one platform 3. In addition, use of the coupler for the hydraulic pipes makes it possible to easily perform replacement work without risk of erroneous work even without special skill or the like.

Note that though the press-in block 4 is exchanged according to the kind and the size of a pile in the above-described embodiment, the press-in block 4 does not have to be configured to be freely attached to and detached from the platform 3. Also in this case, the reaction force block 2 can be exchanged according to the kind and the size of a pile, so that construction of the pile can be performed without much cost and labor. Besides, even a configuration in which the press-in block 4 itself cannot be exchanged may be configured that only the chuck 31 of the press-in block 4 can be exchanged according to the kind and the size of a pile.

The present invention can cope with various piles and is similarly applicable also to the time when attaching a press-in block equipped with a drilling unit having various capabilities such as an auger screw or the like coping with the hard ground. Besides, in the case of constructing, for example, a steel pipe pile in proximity to a steel sheet pile wall, the construction only needs to be performed with the reaction force block 2 tailored to the steel sheet pile specification and the press-in block 4 of the steel sheet pile specification replaced with the press-in block 4 of the steel pipe pile specification. The present invention may be applicable to other commercially available piles such as a tubular sheet pile, a hat-shaped steel sheet pile, straight web sheet pile, a Z-shaped steel sheet pile, a concrete pile, or a concrete sheet pile, or those manufactured by processing them. The present invention is similarly applicable, for example, even to an H-steel pile or a pile in a special shape as long as it can be gripped by the clamp and the chuck.

Note that two kinds or three kinds or more of the slide frame 21 and the leader mast 22 of the platform 3 different in strength and size may be manufactured according to a pile material to be handled and a press-in force and a movable dimension. This makes it possible to cope with more different kinds of piles and the same kind of piles large in dimensional difference.

Preferred embodiments of the present invention have been described above with reference to the accompanying drawings, but the present invention is not limited to the embodiments. It should be understood that various changes and modifications are readily apparent to those skilled in the art within the scope of the technical spirit as set forth in claims, and those should also be covered by the technical scope of the present invention.

Though the case where the chuck is lifted down to press in a pile has been described, for example, in the above-described embodiments, the present invention is similarly applicable also to a case of pulling a pile out of the ground by lifting up the chuck while grasping an existing pile.

INDUSTRIAL APPLICABILITY

The present invention is applicable to construction of pressing a pile into the ground and construction of pulling a pile out of the ground.

EXPLANATION OF CODES

1, 1*a*, 1*b* pile press-in machine
2, 2*a*, 2*b* reaction force block
3 platform
4, 4*a*, 4*b* press-in block
5 hydraulic unit
11, 11*a*, 11*b*, 11*c* clamp
12 saddle
13, 26 slide guide
14, 27 bracket
16, 17 hydraulic cylinder
21 slide frame
22 leader mast
23 front-rear cylinder
31 chuck
32 chuck frame
33 lifting cylinder
36 sliding portion
43 control manifold
45, 46, 47, 51 hydraulic hose
48, 49 dividing manifold
50, 52 coupler

The invention claimed is:

1. A pile press-in machine that receives reaction force from an existing pile to press in a new pile, the pile press-in machine comprising:

a platform configured to receive at least one of a plurality of reaction force blocks and a press-in block, wherein a first reaction force block of the plurality of reaction force blocks is configured for use with the existing pile and at least one other reaction force blocks of the plurality of reaction force blocks is configured for use with a pile having a different shape than the existing pile, the plurality of reaction force blocks each including a reaction force block coupling, the reaction force block couplings configured to be selectively, removably coupled to the platform; and a press-in block coupled to the platform and supported to be freely lifted up and down with respect to the platform to press in the new pile, wherein the reaction force blocks are horizontally moveable relative to the platform during attachment and detachment, wherein each of the reaction force block couplings includes a slide guide that is configured to slidably couple to a slide frame on the platform, and wherein the slide guides of the plurality of reaction force blocks are identical.

2. The pile press-in machine according to claim 1, wherein the press-in block is one of a plurality of press-in blocks, the press-in blocks each including a press-in block coupling that is configured to be selectively, removably coupled to the platform.

3. The pile press-in machine according to claim 1, wherein the reaction force block comprises a plurality of clamps and a saddle mounted with the clamps, the plurality of clamps are configured so that motions of the clamps are controlled by a hydraulic cylinder, and a hydraulic hose that is connected to the hydraulic cylinder and a hydraulic hose that feeds a hydraulic pressure are connected by a coupler.

4. The pile press-in machine according to claim 1, wherein the reaction force blocks and the platform are further coupled by a hydraulic cylinder having one end fixed to one of the slide frame or the reaction force block and the other end coupled to a fixed bracket provided at the other of the slide frame or the reaction force block.

5. The pile press-in machine according to claim 1, wherein the reaction force block and the platform are attached to each other by fixing both ends of the hydraulic cylinder to fixed portions provided at the slide frame and the reaction force block, respectively.

6. The pile press-in machine according to claim 1, wherein the platform includes a slide guide, and the press-in block includes a sliding portion slidably coupled to the slide guide in a vertical direction, and wherein the platform and the press-in block are further coupled by a hydraulic cylinder having one end fixed to the press-in block and the other end connected to a fixed bracket provided at the platform.

7. The pile press-in machine according to claim 3, wherein the hydraulic hose that feeds the hydraulic pressure is connected to a control manifold, and the hydraulic hose connected to the hydraulic cylinder is connected to a dividing manifold, and wherein a coupler provided at the dividing manifold and a coupler attached to a tip of the hydraulic hose connected to the control manifold are coupled.

8. The pile press-in machine according to claim 7, wherein the platform comprises a leader mast, and the couplers are arranged at a rear portion of a saddle located at the rear, in an advancing direction at construction, of the leader mast equipped with the control manifold.

9. The pile press-in machine according to claim 2, wherein each of the plurality of press-in blocks includes a sliding portion for coupling the press-in blocks and the platform.

10. The pile press-in machine according to claim 1, wherein the plurality of kinds of the reaction force blocks include a first reaction force block for a steel sheet pile, a second reaction force block for a steel pipe pile, and a third reaction force block for a concrete pile.

11. The pile press-in machine according to claim 1, wherein the plurality of kinds of the reaction force blocks are a plurality of reaction force blocks according to two kinds or more of the existing piles of the same kind and different dimensions.

12. A pile press-in method using a pile press-in machine, the pile press-in machine comprising:

a first reaction force block that is configured to grip an existing pile having a first shape by a clamp to receive reaction force;

a platform that is horizontally movable relative to the reaction force block; and a press-in block that is coupled to the platform, supported to be freely lifted up and down with respect to the platform at a front of the clamp, and is configured to grip and press in the new pile, wherein the first reaction force block is removable from the platform and replaceable with a second reaction force block according to a different shape and size of a pile than the existing pile, wherein the first and second reaction force blocks include a unified coupling configuration that allows the first and second reaction force blocks to be freely attachable to and detachable from the platform, wherein the unified coupling configuration includes a slide guide that is configured to slidable couple to a slide frame on the platform, and wherein the method comprises selecting one of the first and second reaction force blocks and slidably coupling the reaction block to the platform.

13. The pile press-in method according to claim 12, wherein sizes of coupling portions between a plurality of kinds of press-in blocks each according to a kind and size of the new pile and the platform are unified among a plurality of kinds of the press-in blocks, and the press-in blocks according to the kind and size of the new pile is selected from the plurality of kinds of the press-in blocks freely attachable to and detachable from one platform, and the press-in block is attached to the platform.

14. A pile press-in machine comprising:

a first reaction force block that comprises a first grip configured to grip a first existing pile;

a second reaction force block that comprises a second grip configured to grip a second pile having a different shape than the first existing pile;

a platform having a slide frame; and a first press-in block comprising a first chuck configured to chuck a first new pile, a first size of the first existing pile and the first new pile is the same; wherein the first reaction force block is detachably attachable to the platform, wherein the first reaction force block includes a slide guide that slidably couples to the slide frame on the platform;

the first press-in block is detachably attachable to the platform;

the second reaction force block is detachably attachable to the platform and exchangeable with the first reaction force block;

the first reaction force block is movable horizontally relative to the platform when the first reaction force block is attached to the platform; and the first press-in block is movable vertically when the first press-in block is attached to the platform.

15. The pile press-in machine according to claim 14 comprising:

a second press-in block comprising a second chuck configured to chuck a second new pile, a second size of the second existing pile and the second new pile is the same, the first size and the second size are different; wherein the second reaction force block is detachably attachable to the platform;

the second press-in block is detachably attachable to the platform;

the second reaction force block is movable horizontally when the second reaction force block is attached to the platform; and the second press-in block is movable vertically when the second press-in block is attached to the platform.

* * * * *